US011555329B2

(12) United States Patent
Bakker

(10) Patent No.: US 11,555,329 B2
(45) Date of Patent: Jan. 17, 2023

(54) RE-POSITIONAL DRAWER/DOOR PULLS

(71) Applicant: Mitchell Ray Bakker, Holland, MI (US)

(72) Inventor: Mitchell Ray Bakker, Holland, MI (US)

( * ) Notice: Subject to any disclaimer, the term of this patent is extended or adjusted under 35 U.S.C. 154(b) by 178 days.

(21) Appl. No.: 16/948,759

(22) Filed: Sep. 30, 2020

(65) Prior Publication Data

US 2021/0095494 A1 Apr. 1, 2021

Related U.S. Application Data

(60) Provisional application No. 62/908,298, filed on Sep. 30, 2019.

(51) Int. Cl.
*E05B 1/00* (2006.01)
*A47B 95/02* (2006.01)

(52) U.S. Cl.
CPC ..... *E05B 1/0015* (2013.01); *A47B 95/02* (2013.01); *A47B 2095/024* (2013.01)

(58) Field of Classification Search
CPC ..... E05B 1/0015; A47B 2095/024; A47B 2095/028; A47B 95/02
USPC ..... 16/412–420
See application file for complete search history.

(56) References Cited

U.S. PATENT DOCUMENTS 138,862 A * 5/1873 Corbin ..... E05B 63/0065 70/447
183,477 A * 10/1876 Weeden ..... A47B 95/02 16/420
183,479 A * 10/1876 Weeden ..... A47B 95/02 16/419
2,142,953 A * 1/1939 Raymond ..... A47B 95/02 403/252
2,175,632 A * 10/1939 Maga ..... F16B 5/12 220/759
2,555,783 A * 6/1951 Bryson ..... E06B 7/285 16/412
2,739,026 A * 3/1956 Moore ..... A47B 63/02 40/325
2,882,549 A * 4/1959 Strauss ..... E05B 1/0015 16/415
3,523,322 A * 8/1970 Rossow ..... F25D 23/028 D8/316
3,583,823 A 6/1971 Eaton et al.
4,862,553 A 9/1989 Festoso et al.
5,074,009 A * 12/1991 Simonton ..... A47B 95/02 16/416

(Continued)

*Primary Examiner* — Jeffrey O'Brien
(74) *Attorney, Agent, or Firm* — Dunlap Bennett & Ludwig, PLLC

(57) ABSTRACT

A pull assembly that affords users the option of one of at least three positions along an operatively associated drawer or door board, wherein the drawer or the door board provide the conventional manufacturer pair of bore holes spaced apart. The pull assembly provides three pairs of complimentary holes, each pair spaced apart to align with the pair of bore holes of the drawer or the door board. The three pairs of complimentary holes are arranged so that every other hole of the pull assembly defines a pair of complementary holes, wherein two pull assembly holes are adjacent to each other near a middle portion of the pull assembly. The holes on the back of the pull could be four, five or six aligned to the two boring holes of the door or drawer.

2 Claims, 6 Drawing Sheets

(56) References Cited

U.S. PATENT DOCUMENTS 5,652,999 A 8/1997 Jarvis
5,727,858 A * 3/1998 Shapiro ..... A47B 95/02 16/416
6,003,202 A * 12/1999 Dauterive ..... A47B 95/02 16/419
6,135,621 A * 10/2000 Bach ..... F21S 4/20 74/543
6,421,882 B1 7/2002 Liao et al.
7,007,347 B2 * 3/2006 Roels ..... A47B 88/944 16/415
7,040,726 B2 5/2006 Steflee
7,043,799 B2 * 5/2006 Moody ..... E05B 53/001 16/901
7,043,800 B2 * 5/2006 Moody ..... E05B 53/001 16/901
7,302,736 B2 * 12/2007 Lawler ..... E05B 1/0015 16/443
7,451,525 B2 * 11/2008 Willems ..... B65D 25/2841 16/419
7,698,796 B1 * 4/2010 Dowling ..... E05F 3/227 29/402.08
8,132,295 B1 * 3/2012 Otis ..... A47B 95/02 16/415
8,646,151 B2 * 2/2014 Kopp ..... E04F 11/1802 16/110.1
8,910,346 B1 * 12/2014 Schafer ..... E05D 5/02 16/382
9,578,999 B2 * 2/2017 Schwartz ..... A47K 10/04
D799,303 S * 10/2017 Boeltl ..... D8/315
9,909,338 B1 * 3/2018 Abrahams ..... E05B 1/0015
10,173,312 B2 1/2019 Franssen
D859,956 S * 9/2019 McNaughton ..... D8/307
10,655,360 B1 * 5/2020 Desi ..... E05B 79/06
10,893,749 B1 * 1/2021 Pifer ..... E05B 1/0015
11,365,558 B2 * 6/2022 Simon ..... E05B 3/04
D959,952 S * 8/2022 Zemel ..... D8/307
2002/0083556 A1 7/2002 Lai
2003/0213094 A1 11/2003 Wills
2004/0098940 A1 * 5/2004 Latessa ..... E05F 3/22 52/514
2007/0144562 A1 * 6/2007 Classen ..... A47L 15/4257 134/58 DL
2009/0106942 A1 4/2009 Dellorfano
2009/0195134 A1 * 8/2009 Liu ..... E05B 65/46 312/348.6
2010/0139046 A1 * 6/2010 Daniels ..... E05B 1/0015 16/417
2010/0294806 A1 * 11/2010 McDowell ..... E05B 1/0069 222/173
2011/0179603 A1 * 7/2011 Edelen ..... A47B 95/02 16/415
2016/0340929 A1 * 11/2016 Gagnon ..... E05B 1/0015
2017/0081874 A1 * 3/2017 Daniels ..... E05B 1/0015
2021/0093085 A1 * 4/2021 Pifer ..... A47B 95/02
2021/0310273 A1 * 10/2021 Askren ..... E05B 1/0015
2021/0348423 A1 * 11/2021 Brown ..... E05B 1/0015
2021/0363779 A1 * 11/2021 Bennett ..... E05B 1/0015
2022/0010585 A1 * 1/2022 Lin ..... E05B 53/001
2022/0018154 A1 * 1/2022 Madden ..... E05B 53/001
2022/0095795 A1 * 3/2022 Jonsson ..... A47B 95/02
2022/0136706 A1 * 5/2022 Jell ..... E05B 17/10 16/412

* cited by examiner

RE-POSITIONAL DRAWER/DOOR PULLS

CROSS-REFERENCE TO RELATED APPLICATION

This application claims the benefit of priority of U.S. provisional application No. 62/908,298, filed 30 Sep. 2019, the contents of which are herein incorporated by reference.

BACKGROUND OF THE INVENTION

The present invention relates to door/drawer pulls and, more particularly, a re-positional door/drawer pull that can be positioned across a range of positions, and thus be selectively optimized by an end user without special tools with only requiring two mounting holes.

There is only one set of (two) boring holes centered on each door or drawer in order to allow the manufacturer to have non-handed drawers at the factory, thereby providing convenience to the manufacturer in terms of being able to manufacture universal and non-handed parts. This saves the manufacturer on stockkeeping units/unnecessary inventory of doors/drawers board in handed/unsymmetrical locations.

This dictated placement of a pull on the drawer or the door front, however, may be in an inconvenient or wrong location when installed. This can result in post-installation problems, such as egress-related issues for the user—for instance, if the pull is too far from the user this makes it difficult to open the door or drawer. Moreover, the post-installation problem may be visual in nature when, for example, the designer desires to have the pulls justified to the right or left but cannot achieve this because the pull can only be installed in one location, predetermined by the manufacturer of the drawer or door.

Currently, pulls are designed to be in a fixed, predetermined location at the time the drawer or door is manufactured. This does not allow for choice or the ability to move the pull for optimum ergonomics or preferred design location, without modifying the underlying drawer or door, which can result in unsightliness. Even if the pulls are currently in the proper position, re-positioning/re-configuring the case (a common practice) will often result in the pulls being in an undesirable location. Unfortunately, current pulls on the market do not allow for their relocation after production and/or manufacturing.

As can be seen, there is a need for a re-positional door/drawer pull that can be positioned and thus optimized by an end user across a range of position without special tools with only requiring two mounting holes.

The present invention has multiple bored holes on the back side of the pull which affords the installer or the end user the choice of pull location—right, left or center—at the time of installation or re-positioning. Furthermore, if the pulls are pre-installed before shipment, the pulls can easily be relocated on site.

The present invention allows for relocation without effecting the conventional two boring hole arrangement preferred by manufacturers, while affording the end user with a choice of location without any modification or additional prefabrication to the case or the pull or the use of any specialized tools. In short, the present invention is an improvement to what currently exists as all other pulls have a predetermined location that is fixed once the hole borings are set as no variation is allowed. The pull embodied in the present invention can be re-located left, right or center from only one set of centered mounted bored holes on the door or drawer—a choice of three locations at the factory, at installation, or by the end user after initial installation.

SUMMARY OF THE INVENTION

In one aspect of the present invention, a pull assembly includes the following: a pull portion; a base portion; six holes in a rear surface of the base portion; and the six holes defines three complementary pairs of a predefined spacing, wherein a first and fourth holes are a first complementary pair, wherein the second and fifth holes are a second complementary pair, and wherein the third and sixth holes are a third complementary pair.

In another aspect of the present invention, an adjustable pull system for a drawer or a door having only one pair of bore holes, the system comprising: a pull assembly includes the following: a pull portion; a base portion; six holes in a rear surface of the base portion; and the six holes defines three complementary pairs of a predefined spacing, wherein a first and fourth holes are a first complementary pair, wherein the second and fifth holes are a second complementary pair, and wherein the third and sixth holes are a third complementary pair, wherein associating the first complementary pair with said pair of bore holes defines a first position of the pull assembly relative to the drawer or the door, wherein associating the second complementary pair with said pair of bore holes defines a second position of the pull assembly relative to the drawer or the door; and associating the third complementary pair with said pair of bore holes defines a third position of the pull assembly relative to the drawer or the door.

In yet another aspect of the present invention, the pull assembly includes the following: a pull portion; a base portion; and a plurality of pull assembly holes in a rear surface of the base portion, wherein the plurality of pull assembly holes defines a plurality of complementary pairs of a predefined spacing, wherein the predefined spacing aligns with a two-bore hole configuration of an underlying door or drawer board.

In yet another aspect of the present invention, the plurality of pull assembly holes of the pull assembly defines an adjacency configuration, the adjacency configuration includes the following: two pull assembly holes centrally located along the pull portion; the two pull assembly holes spaced apart by an adjacency distance; and the adjacency distance is at least one third less that a distance that defines a non-adjacent spacing of the remaining pull assembly holes of the plurality of the pull assembly holes.

These and other features, aspects and advantages of the present invention will become better understood with reference to the following drawings, description and claims.

BRIEF DESCRIPTION OF THE DRAWINGS

FIGS. 4A, 4B, 4C show a related set of exploded top plan view, a top plan view, and a front elevation view, respectively, of an exemplary embodiment of the present invention, illustrated a left-side position;

FIGS. 5A, 5B, 5C show a related set of exploded top plan view, a top plan view, and a front elevation view, respectively, of an exemplary embodiment of the present invention, illustrated a central position;

FIGS. 6A, 6B, 6C show a related set of exploded top plan view, a top plan view, and a front elevation view, respectively, of an exemplary embodiment of the present invention, illustrated a right-side position;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a pull assembly that affords users the option of one of at least three positions along an operatively associated drawer or door board, wherein the drawer or the door board provide the conventional manufacturer pair of bore holes spaced apart. The pull assembly provides three pairs of complimentary holes, each pair spaced apart to align with the pair of bore holes of the drawer or the door board. The three pairs of complimentary holes are arranged so that every other hole of the pull assembly defines a pair of complementary holes, wherein two pull assembly holes are adjacent to each other near a middle portion of the pull assembly.

Figure 3A:
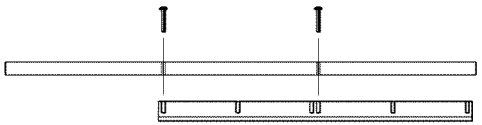
FIGS. 3A, 3B, 3C show a related set of exploded top plan view, a top plan view, and a front elevation view, respectively, of an exemplary embodiment of the present invention, illustrated a right-side position.
Figure 3B:
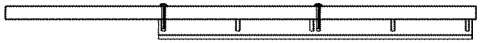
Figure 3C:
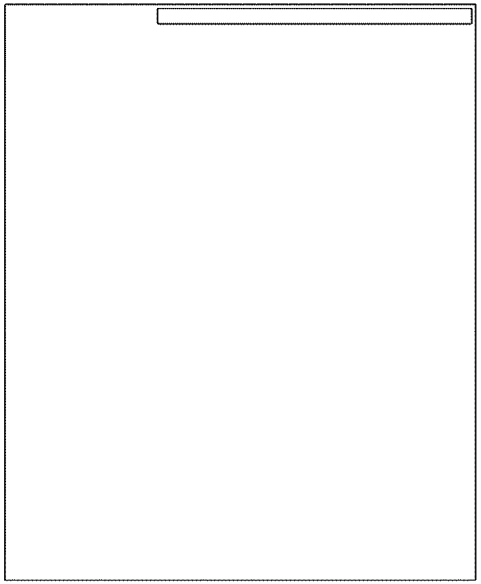
Figure 2A:
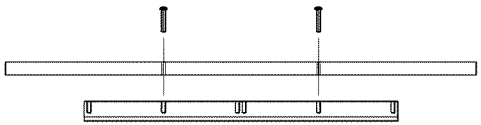
FIGS. 2A, 2B, 2C show a related set of exploded top plan view, a top plan view, and a front elevation view, respectively, of an exemplary embodiment of the present invention, illustrated a central position.
Figure 2B:
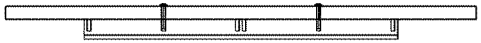
Figure 2C:
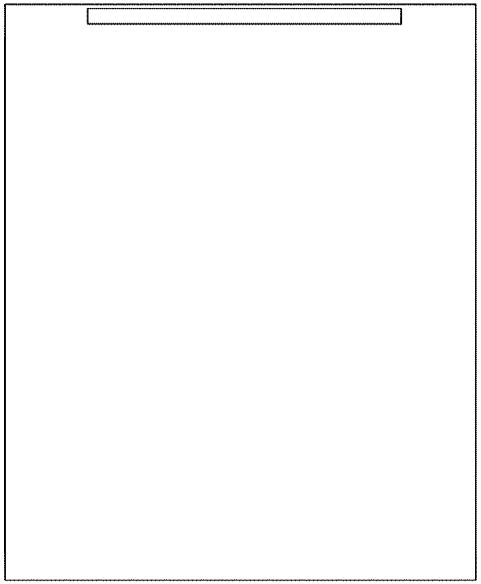
Figure 1A:
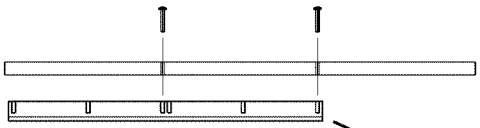
FIGS. 1A, 1B, 1C show a related set of exploded top plan view, a top plan view, and a front elevation view, respectively, of an exemplary embodiment of the present invention, illustrated a left-side position.
Figure 1B:
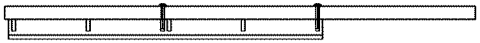
Figure 1C:
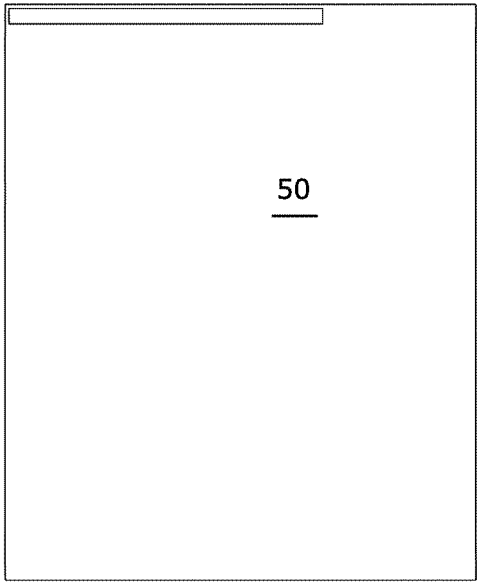
Figure 6A:
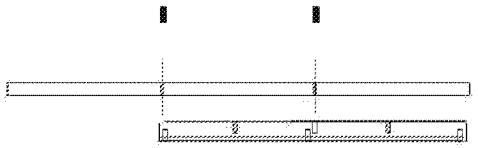
Figure 68:
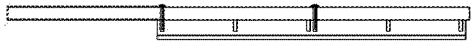
Figure 6C:
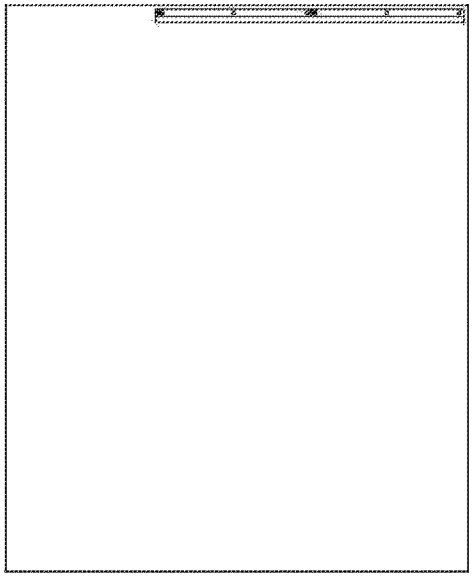
Figure 5A:
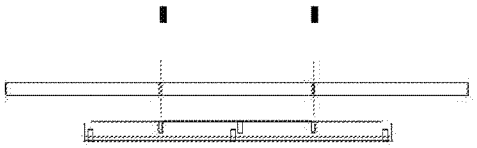
Figure 58:
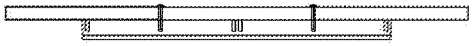
Figure 5C:
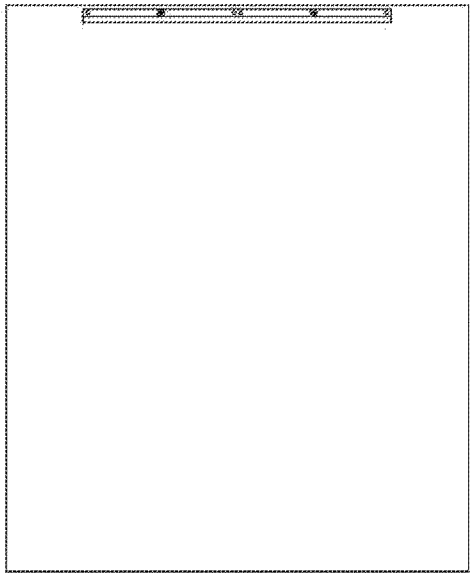
Figure 4A:
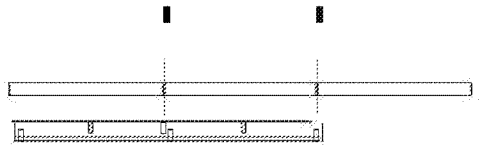
Figure 48:
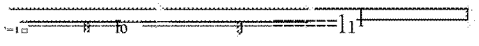
Figure 4C:
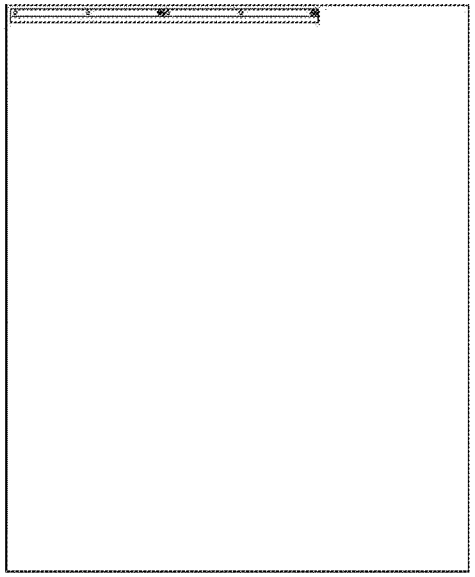
Figure 7C:
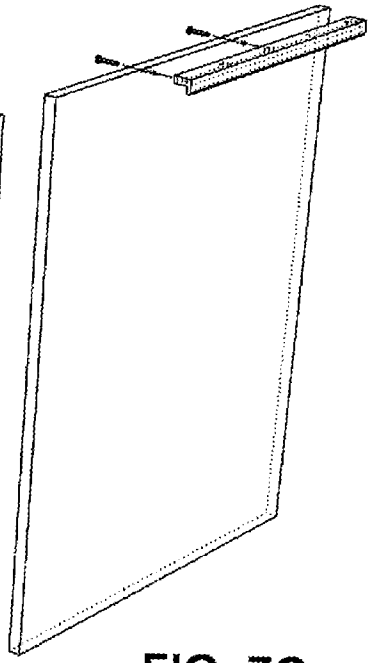
FIGS. 7A, 7B, 7C show a related set of perspective views of an exemplary embodiment of the present invention, illustrating the left-side position, the central position, and the right-side position.
Figure 7B:
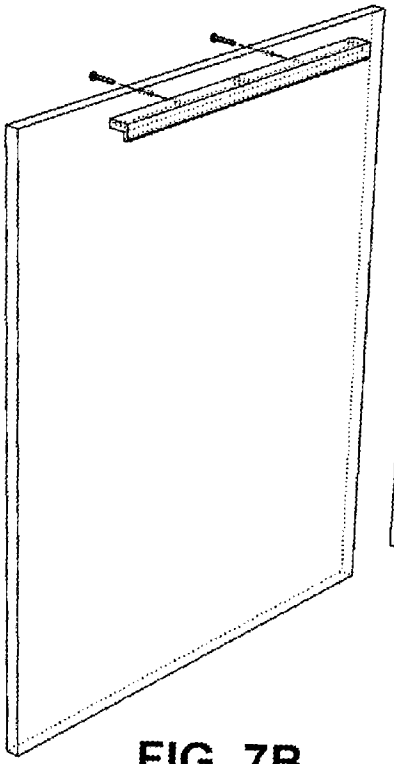
Figure 7A:
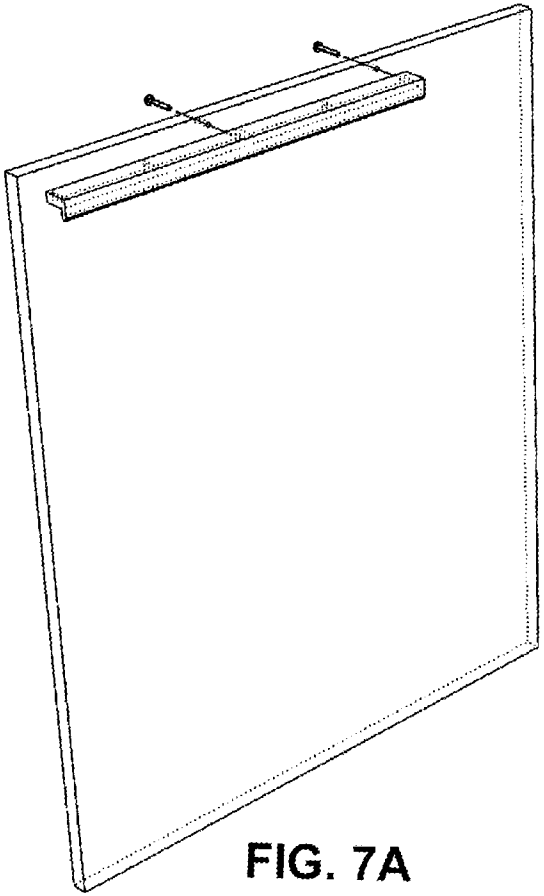
Figure 8C:
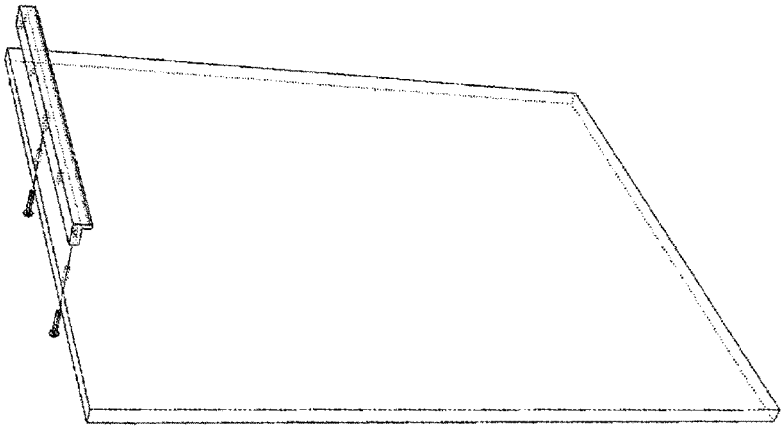
FIGS. 8A, 8B, 8C show a related set of exploded perspective views of an exemplary embodiment of the present invention, illustrating the left-side position, the central position, and the right-side position.
Figure 8B:
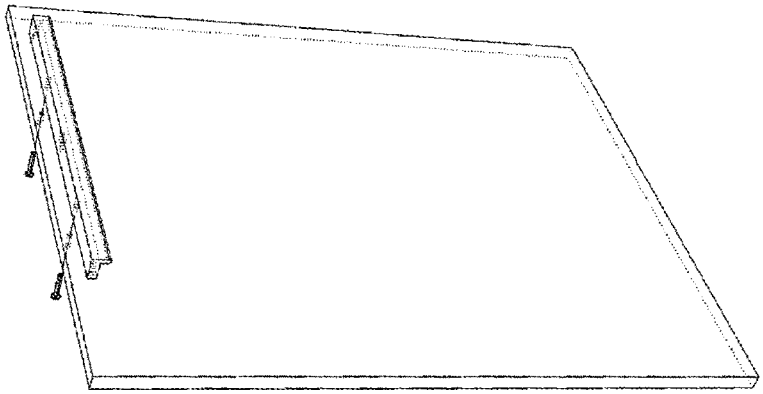
Figure 8A:
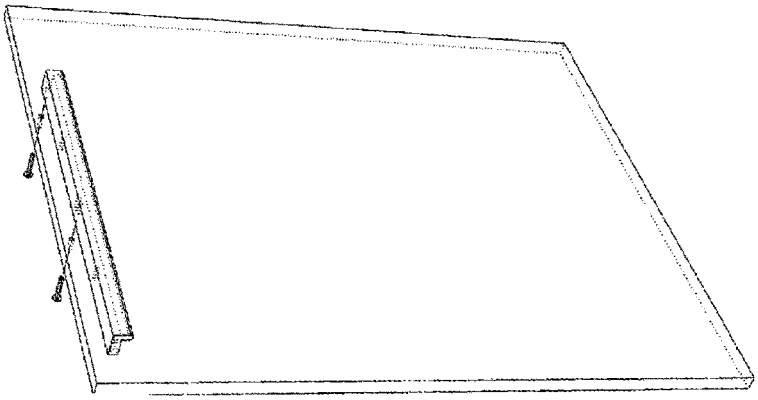
Figure 9:
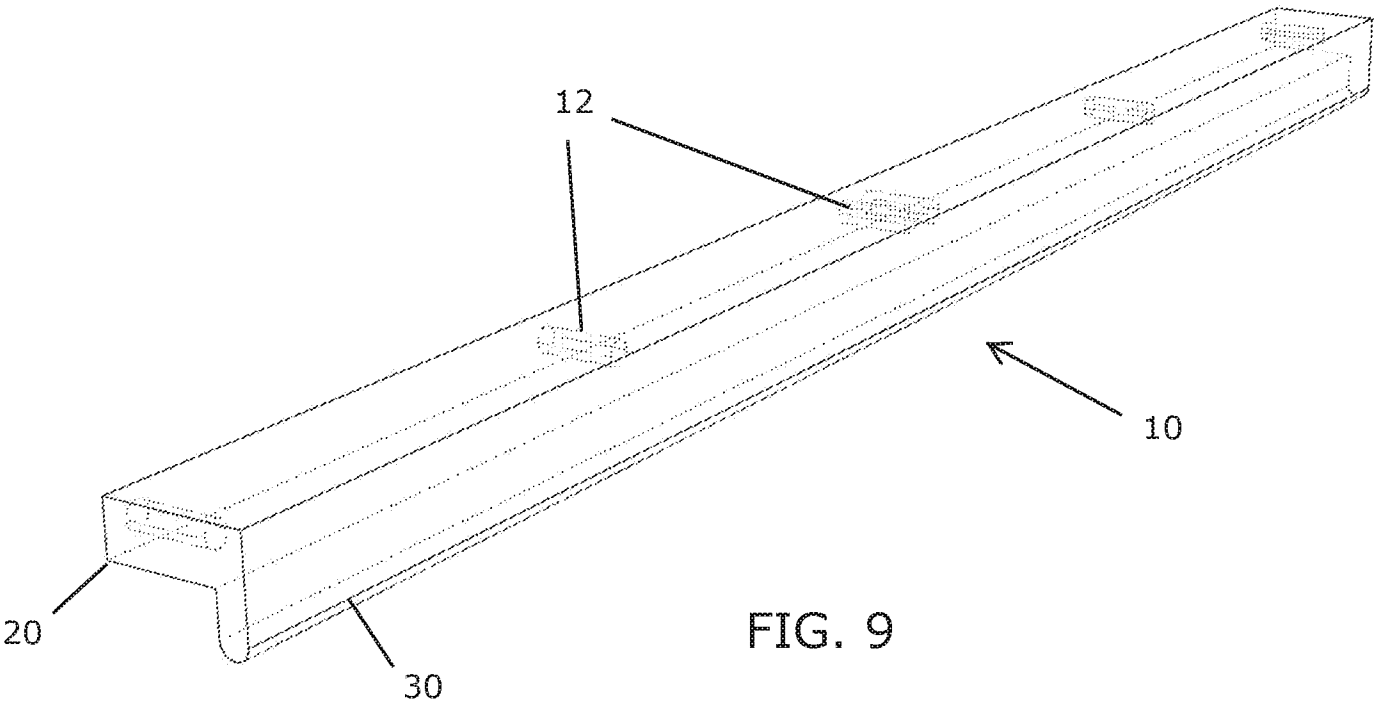
FIG. 9 is perspective view of an exemplary embodiment of the present invention.
Figure 10A:
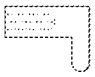
FIGS. 10*a*, 10*b*, and 10*c* show a related set of side elevation, front elevation, and top plan views, respectively, of an exemplary embodiment of the present invention.
Figure 10B:
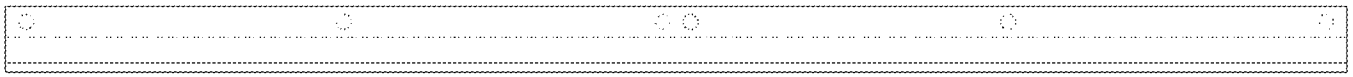
Figure 10C:
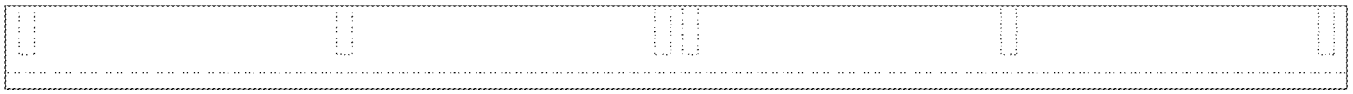

Referring now to FIGS. 1 through 10*c*, the present invention may include an elongated pull assembly 10 made from extruded aluminum or any other material capable of performing the functions described herein without failing. The pull assembly 10 may have a base portion 20 and a protruding pull portion 30. In certain embodiments, the base and pull portions 20 and 30 form an L-shape, while in other embodiments, other shapes may be defined as long as the base portion 20 can support the pull assembly holes 12, and the pull portion 30 can be manually engaged to operate as a pulling structure.

A plurality of pull assembly holes 12 are provided along a rear side of the base portion 20, which define two or more pairs of complementary holes, which may be dictated by the predefined spacing of the two-bore hole configuration 40 of the underlying door or drawer boards 50. In certain situations, the number of pull assembly holes 12 may be dictated by a desired aesthetic. The plurality of pull assembly holes 12 could consist of four to six or more pull assembly holes 12.

In certain embodiments, there may be six pull assembly holes 12 along the rear side of the base portion 20, providing three pairs of complementary holes. When there is an even number of pull assembly holes 12 an 'adjacency configuration' may be employed, wherein the two middle pull assembly holes 12 are adjacent to each other. The distance of this adjacency (of the 'adjacency configuration' of the two middle pull assembly holes 12) is defined by an adjacency distance that is at least one third less that a distance that defines the spacing of the remaining pull assembly holes 12.

In other embodiments, there may be four or five pull assembly holes 12 that also provide three pairs of complementary holes, though does not employ the two above-mentioned pull assembly holes. The present invention is not limited to an exact number four, five, or six holes on the rear side of the base portion 20, but rather the present invention is based on the pull being relocatable—left, right or center with only the two-bore hole configuration 40 in the drawer/door.

With that said the 'adjacency configuration' provides greater stability when installed in a left or right configuration as the holes used (screwed through the back) are further apart. The choice of six pull assembly holes enables a user to use the widest pull possible and still maintain proper stable attachment to the door/drawer. For example, if a user wanted to bring the pull assembly 10 close to the right or left of the door or drawer—six pull assembly holes 12 enables this while four or five pull assembly holes 12 may force the pull portion 30 to be narrower and less desirable. In any event, a desired pair of complementary holes selectively defined from the plurality of assembly holes 12 can be aligned with the two-bore hole configuration 40 predefined along conventional door or drawer boards 50, as illustrated in FIGS. 1-6.

Thereby allowing for the pull assembly 10 to be attached to the door or drawer 50 in one of three locations—left, right, or center—with two screws. This allows the end user the choice of pull location or relocation thereof without any additional modification to the door or drawer. Thus, even though there are only two predefined holes 40 in the door or drawer 50, the pull assembly 10 can be connected at one of three locations via screws through the two bored holes on the door or drawer 50. This allows for optimum ergonomics or desired design preferences with only one pull assembly 10.

A method of making the present invention may include the following. A manufacturer, once the pull assembly 10 is extruded or otherwise formed, the pull assembly 10 is cut to predetermined lengths that corresponds to the whole placements in the door/drawer 50. The cut lengths are then bored and tapped in the plurality of locations that again correspond and define three pairs of complementary pull assembly holes that align with the two holes bored in the door/drawer. The holes are symmetrical but allow for asymmetrical placements (left-side, center, and right-side) on the door/drawer.

A method of using the present invention may include the following. The pull assembly 10 disclosed above may be provided. The pull assembly 10 location can be determined at specification and installed at the factory/manufacturing facility. However, the pull assemblies 10 can be shipped uninstalled and be attached on site. Either way, the end user can relocate the pull assembly 10 if pre-installed or select their desired location for the uninstalled pull assembly 10. Furthermore, the end user could use the pull assembly 10 in one location for a period of time and at any subsequent time change the location without any addition parts and with a common screwdriver. A person would do this to ergonomically optimize the pull location or for a desired design aesthetic when furniture case is rearranged (common practice).

It should be understood, of course, that the foregoing relates to exemplary embodiments of the invention and that modifications may be made without departing from the spirit and scope of the invention as set forth in the following claims.

What is claimed is:

1. An adjustable pull system for a drawer or a door having only one pair of bore holes, the system comprising:

a pull assembly comprising:

a pull portion;

a base portion;

six holes in a rear surface of the base portion; and the six holes defines three complementary pairs of a predefined spacing, wherein a first and fourth holes are a first complementary pair, wherein the second and fifth holes are a second complementary pair, and wherein the third and sixth holes are a third complementary pair, wherein associating the first complementary pair with said pair of bore holes defines a first position of the pull assembly relative to the drawer or the door, wherein associating the second complementary pair with said pair of bore holes defines a second position of the pull assembly relative to the drawer or the door; and associating the third complementary pair with said pair of bore holes defines a third position of the pull assembly relative to the drawer or the door.

2. The system of claim 1, wherein the six pull assembly holes defines an adjacency configuration comprising:

two pull assembly holes centrally located along the pull portion;

the two pull assembly holes spaced apart by an adjacency distance; and the adjacency distance is at least one third less than a distance that defines a non-adjacent spacing of a remaining four of the six pull assembly holes.

* * * * *